US011732223B2

(12) United States Patent
Troxler et al.

(10) Patent No.: US 11,732,223 B2
(45) **Date of Patent: *Aug. 22, 2023**

(54) SOLVENT COMPOSITIONS FOR REMOVING PETROLEUM RESIDUE FROM A SUBSTRATE AND METHODS OF USE THEREOF

(71) Applicant: Crude Spill Cleaning Company, Inc., Raleigh, NC (US)

(72) Inventors: Robert Ernest Troxler, Raleigh, NC (US); Nael Naguib Zaki, Shawnee, KS (US)

(73) Assignee: Crude Spill Cleaning Co. Inc, Raleigh, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/316,987

(22) Filed: May 11, 2021

(65) Prior Publication Data

US 2021/0261889 A1 Aug. 26, 2021

Related U.S. Application Data

(60) Continuation of application No. 15/782,704, filed on Oct. 12, 2017, now Pat. No. 11,001,789, which is a (Continued)

(51) Int. Cl.

| | |
|---|---|
| ***B08B 3/08*** | (2006.01) |
| ***B08B 3/10*** | (2006.01) |
| ***C11D 3/20*** | (2006.01) |
| ***C11D 3/30*** | (2006.01) |
| ***C11D 3/43*** | (2006.01) |
| ***C11D 7/50*** | (2006.01) |
| ***B08B 3/04*** | (2006.01) |
| ***C11D 1/52*** | (2006.01) |

(Continued)

(52) U.S. Cl.

CPC ..... *C11D 7/5022* (2013.01); *B08B 3/022* (2013.01); *B08B 3/024* (2013.01); *B08B 3/026* (2013.01); *B08B 3/028* (2013.01); *B08B 3/04* (2013.01); *B08B 3/08* (2013.01); *B08B 3/14* (2013.01); *C11D 1/526* (2013.01); *C11D 1/58* (2013.01); *C11D 1/62* (2013.01); *C11D 1/66* (2013.01); *C11D 1/74* (2013.01); *C11D 3/188* (2013.01); *C11D 3/2003* (2013.01); *C11D 3/2041* (2013.01); *C11D 3/2093* (2013.01); *C11D 3/28* (2013.01); *C11D 3/30* (2013.01); *C11D 3/3445* (2013.01); *C11D 3/43* (2013.01); *C11D 3/50* (2013.01); *C11D 7/248* (2013.01); *C11D 7/266* (2013.01); *C11D 11/0023* (2013.01); *C11D 11/0041* (2013.01); *C11D 11/0076* (2013.01)

(58) Field of Classification Search

CPC ..... C11D 1/58; C11D 1/62; C11D 3/2003; C11D 3/2041; C11D 3/3445; C11D 3/28; C11D 3/30; B08B 3/022; B08B 3/024; B08B 3/026; B08B 3/028; B08B 3/08; B08B 3/14

USPC ..... 510/234, 237, 238, 475, 500, 505, 506; 134/22.19, 23.24, 25.4, 25.5

See application file for complete search history.

(56) References Cited

U.S. PATENT DOCUMENTS 5,143,639 A 9/1992 Krawack
5,413,729 A 5/1995 Gaul
(Continued)

*Primary Examiner* — Gregory R Delcotto
(74) *Attorney, Agent, or Firm* — NK Patent Law PLLC

(57) ABSTRACT

A method of cleaning highway and road construction equipment is disclosed.

8 Claims, 1 Drawing Sheet

Related U.S. Application Data continuation of application No. 14/617,146, filed on Feb. 9, 2015, now abandoned, which is a continuation of application No. 13/618,074, filed on Sep. 14, 2012, now Pat. No. 8,951,952, which is a division of application No. 10/791,427, filed on Mar. 2, 2004, now Pat. No. 8,951,951.

(51) Int. Cl.

| | |
|---|---|
| ***C11D 1/66*** | (2006.01) |
| ***C11D 1/74*** | (2006.01) |
| ***C11D 3/18*** | (2006.01) |
| ***C11D 3/50*** | (2006.01) |
| ***C11D 7/24*** | (2006.01) |
| ***C11D 7/26*** | (2006.01) |
| ***C11D 11/00*** | (2006.01) |
| ***B08B 3/14*** | (2006.01) |
| ***C11D 1/58*** | (2006.01) |
| ***B08B 3/02*** | (2006.01) |
| ***C11D 3/28*** | (2006.01) |
| ***C11D 3/34*** | (2006.01) |
| ***C11D 1/62*** | (2006.01) |

(56) References Cited

U.S. PATENT DOCUMENTS

| | | | | |
|---|---|---|---|---|
| 6,017,862 | A | 1/2000 | Doyel et al. | |
| 6,030,466 | A | 2/2000 | Myers, II | |
| 6,150,318 | A | 11/2000 | Silvester et al. | |
| 6,281,189 | B1 | 8/2001 | Heimann et al. | |
| 6,284,720 | B1 | 9/2001 | Opre | |
| 6,395,103 | B1 | 5/2002 | Machac, Jr. et al. | |
| 6,544,942 | B1 | 4/2003 | Smith et al. | |
| 6,838,426 | B1 | 1/2005 | Zeilinger | |
| 8,951,951 | B2 | 2/2015 | Zaki et al. | |
| 8,951,952 | B2 | 2/2015 | Zaki et al. | |
| 11,001,789 | B2 * | 5/2021 | Troxler | C11D 7/266 |
| 2003/0083220 | A1 | 5/2003 | Doyel et al. | |
| 2003/0125223 | A1 | 7/2003 | Denton | |
| 2004/0229981 | A1 | 11/2004 | Petri | |

* cited by examiner

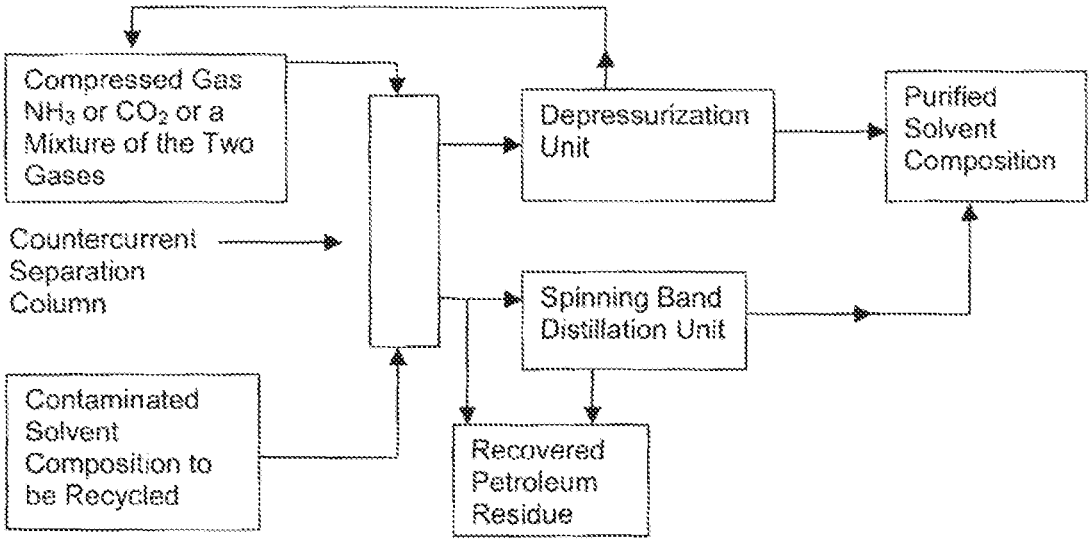
Compressed Gas $NH_3$ or $CO_2$ or a Mixture of the Two Gases
Countercurrent Separation Column
Contaminated Solvent Composition to be Recycled
Depressurization Unit
Spinning Band Distillation Unit
Recovered Petroleum Residue
Purified Solvent Composition

SOLVENT COMPOSITIONS FOR REMOVING PETROLEUM RESIDUE FROM A SUBSTRATE AND METHODS OF USE THEREOF

CROSS REFERENCE TO RELATED APPLICATIONS

This application is a continuation of U.S. patent application Ser. No. 15/782,704 filed on Oct. 12, 2017 and entitled "SOLVENT COMPOSITIONS FOR REMOVING PETROLEUM RESIDUE FROM A SUBSTRATE AND METHODS OF USE THEREOF", being issued as U.S. Pat. No. 11,001,789 on May 11, 2021, which is a continuation of U.S. patent application Ser. No. 14/617,146 filed on Feb. 9, 2015 and entitled "Solvent compositions for removing petroleum residue from a substrate and methods of use thereof", which is a continuation of U.S. patent application Ser. No. 13/618,074 filed on Sep. 14, 2012 and entitled "SOLVENT COMPOSITIONS FOR REMOVING PETROLEUM RESIDUE FROM A SUBSTRATE AND METHODS OF USE THEREOF", now U.S. Pat. No. 8,951,952 issued on Feb. 10, 2015, which is a divisional of U.S. patent application Ser. No. 10/791,427 filed on Mar. 2, 2004 and entitled "Solvent compositions for removing petroleum residue from a substrate and methods of use thereof", now U.S. Pat. No. 8,951,951 issued on Feb. 10, 2015, the disclosure of all of which is incorporated herein by reference in its entirety.

TECHNICAL FIELD

The presently disclosed subject matter generally relates to solvent compositions for removing petroleum residue from a substrate and methods of use thereof. More particularly, the presently disclosed subject matter relates to water-soluble solvent compositions, which can be employed in removing petroleum residue from a substrate.

BACKGROUND ART

The build-up of petroleum residue, such as asphalt and asphalt-related liquid, on processing equipment used in highway and road construction, as well as on equipment used in petroleum and chemical processing, storage and transport, has long been problematic. After a certain level of buildup occurs, the equipment is often no longer capable of being used for its intended purpose. Accordingly, it becomes necessary to clean such equipment. Diesel fuel (or a similar type of fuel) has been used in the past for cleaning construction equipment. The use of diesel fuel-based solvents, however, has largely fallen into disfavor due to heightened environmental concerns. See, e.g., Federal Water Pollution Control Act Amendments of 1972, Pub. L. 92-500, § 311 (b)(1).

Several biodegradable solvents have been formulated as an alternative to diesel-fuel for removing petroleum residue from a substrate. Most of these solvent compositions, however, do not meet all of the requirements mandated by the United States Department of Transportation (U.S. DOT) for a solvent to be considered as an environmentally benign biodegradable substitute for diesel fuel. The main criteria set forth by the U.S. DOT (through the adoption of the U.S. Environmental Protection Agency (EPA) regulations) for a solvent composition to be accepted as an efficient, environmentally friendly substitute for diesel fuel are given as follows:

First, the solvent should be biodegradable and pose no health hazards. There is no single definition of biodegradability, however, throughout the United States and internationally there is a wide range of environmentally preferable definitions. The ASTM standards committee has defined biodegradability in terms of the degree of degradation, time, and test methodology. Despite these definitions, there are two widely used designations for biodegradability: readily and inherently. Readily biodegradable is defined as degrading 80 percent within 21 days as measured by the decrease of a test sample. This type of degradation is preferable because, in most cases, the fluid will degrade long before environmental damage has occurred. Thus, readily biodegradable materials require little in terms of long-term bioremediation. Inherent biodegradability, is defined as having the propensity to biodegrade, with no indication of timing or degree.

Second is efficiency. A solvent could be biodegradable, but still be inefficient in removing the binder from the surface of a substrate, e.g., asphalt paving equipment. Therefore, a successful substitute for diesel fuel should have the ability to remove asphalt residue buildup with an efficiency value that is equal to, or greater than, that of diesel fuel. In this respect, the North Carolina Department of Transportation (NCDOT), in collaboration with the Department of Civil Engineering, North Carolina State University, Raleigh, N.C., devised a standard method for assessing the efficiency of diesel fuel biodegradable solvent substitutes. See Kulkarni, M., et al., J. of Testing and Evaluation, 31(5), 429-437 (2003). According to this method, a solvent that has an efficiency value that is equal to or greater than that of diesel fuel in removing asphalt binder coated on an aluminum surface is considered acceptable as a successful substitute for diesel fuel, provided that it meets all other environmental, health, and fire hazards criteria.

The standard method can be briefly described in the following steps: Contacting a specified mass of asphalt binder (e.g., bitumen) having a specified surface area with a specified mass of the solvent for a specified period of time, followed by a water rinsing step for a specified period of time, drying to constant weight in an oven, and finally calculating the weight loss of the asphalt layer as a percentage efficiency of the solvent (the greater the amount of asphalt removed, the higher the efficiency value). For every solvent tested, a control sample of diesel fuel is tested for comparison, and the solvent that scores an efficiency value equal to or greater than that of diesel is accepted as an efficient environmentally benign substitute for diesel fuel. The reason for implementing the water rinse step is to simulate the fact that asphalt paving workers usually apply the cleaning solvent on their equipment or truck beds, followed by water rinsing to prevent the residual cleaning solvent from stripping bitumen (often referred to as "binder" in the asphalt industry) from the asphalt. Typical binder contents in most asphalt mix designs range from 3 to 8 wt %. Stripping of the binder by the solvent is undesirable because this will result in decreasing the amount of binder in the asphalt mix, which will downgrade the asphalt quality and render it out of specification. Stripped asphalt mixes are more vulnerable to fatigue cracking and the presence of the solvent in the mix will alter the viscosity of the mix by making it softer than designed, which will alter the mechanical properties of the asphalt. On the other hand, the presence of the residual asphalt cleaning solvent will not allow the proper application of an asphalt release agent, which is needed to prevent the asphalt from sticking to the equipment surface, or truck bed. Therefore, based on these factors, it is desirable, from the application point of view, that the solvent be water compatible/soluble.

Third, the solvent should not pose fire hazards during application, and/or storage. In this respect, the U.S. DOT Hazardous Materials regulations define flammable liquids as having a flash point of less than 141° F. (60.55° C.). See U.S. Department of Transportation Hazardous Materials Regulations, 49 C.F.R. Part 173.120. Another closely related definition is found in the U.S. EPA Hazardous Waste regulations. See U.S. Environmental Protection Agency Regulations, 40 C.F.R. Part 261.21. The EPA regulations define an ignitable liquid as having a flash point less than 140° F. (60° C.). Both sets of regulations require the flash point to be determined by a closed-cup ASTM D-93 method. Although pure d-limonene is considered to be an environmentally benign, efficient asphalt solvent, its low flash point (46° C.) prevents it from being used solely as a substitute for diesel fuel. Any solvent formulation that contains d-limonene in a percentage low enough not to bring the flash point of the formulation below 60° C., however, probably would be considered an acceptable non-ignitable solvent.

Fourth, the solvent should not contain trace amounts of Volatile Organic compounds (VOCs) above the limit mentioned in EPA method 8260B, Office of Solid Waste, United States Environmental Protection Agency, incorporated herein by reference in its entirety. This standard method describes the use of a Gas Chromatography-Mass Spectroscopy (GC-MS) method of analysis to detect VOCs in different substrates, such as ground and surface water, aqueous sludges, caustic liquors, acid liquors, waste solvents, oily wastes, mousses, tars, fibrous wastes, polymeric emulsions, filter cakes, spent carbons, spent catalysts, soils, sediment soil, and water streams.

Fifth, the solvent should have a neutral pH value, i.e., a pH value of about 7, and not have a corrosive effect on the metal surfaces and containers.

Due to the lack of a solvent formulations that would comply with all five primary criteria required for an environmentally benign asphalt solvent, the presently disclosed subject matter was developed to fill the need for improved solvent compositions and methods for removing petroleum residue, in general, and bitumen, in particular, from a substrate.

SUMMARY

Embodiments of the presently disclosed subject matter include solvent compositions for removing petroleum residue from a substrate and methods of use thereof.

In one aspect, disclosed is a water-soluble composition for removing petroleum residue from a substrate. In representative embodiments, the composition comprises:

(a) from about 10% to about 60% by weight of an aromatic ester;
(b) from about 30% to about 60% by weight of an aliphatic ester;
(c) from 0% to about 15% by weight of a co-solvent;
(d) from 0% to about 10% by weight of one of a cyclic terpene and a terpenoid;
(e) from 0% to about 1% by weight of an odor-masking agent; and
(f) from 0% to about 20% by weight of a nonionic surfactant.

In some embodiments, the composition further comprises water. In still other embodiments, the composition comprises an aqueous solution.

In another aspect, disclosed is a method of removing petroleum residue from a substrate. The method comprises contacting the substrate with a solvent composition comprising:

(a) from about 10% to about 60% by weight of an aromatic ester;
(b) from about 30% to about 60% by weight of an aliphatic ester;
(c) from 0% to about 15% by weight of a co-solvent;
(d) from 0% to about 10% by weight of one of a cyclic terpene and a terpenoid;
(e) from 0% to about 1% by weight of an odor-masking agent; and
(f) from 0% to about 20% by weight of a nonionic surfactant.

Other additives can be added to the composition, including, but not limited to, corrosion inhibitors, thickening agents, buffer solutions, and biocides, without altering the basic specifications required by the U.S. DOT for an environmentally benign solvent.

For example, a petroleum residue, e.g., asphalt, can be removed from a substrate, e.g., a workpiece, such as a tool, or a truck bed, by contacting the substrate with the composition. The solvent can be sprayed with a regular spray gun on a truck bed contaminated with asphalt residue. The solvent traces present on the truck bed can be removed with water, which enables the application of an asphalt release agent on the truck bed. In some embodiments, the method comprises dissolving the petroleum residue in the composition. In some embodiments, the method further comprises recycling the solvent composition after it has been used to remove petroleum residue from the substrate.

Thus, it is an object of the presently disclosed subject matter to provide a novel solvent composition for removing a petroleum residue (e.g., asphalt) from a substrate (e.g., a workpiece such as a tool, or a truck bed, or a rolling compactor).

It is another object of the presently disclosed subject matter to provide a novel method for removing a petroleum residue (e.g., asphalt) from a substrate (e.g., a workpiece such as a tool, a crude oil storage tank, gas-oil separator, or petroleum pipeline), wherein, in some embodiments, the method further comprises recycling the solvent composition after it has been used to remove petroleum residue from the substrate.

These and other objects are addressed in whole or in part by the presently disclosed subject matter. Other aspects and objects will become evident as the description proceeds when taken in connection with the accompanying Examples as best described hereinafter.

DESCRIPTION OF THE DRAWINGS

FIG. 1 is a schematic drawing of a countercurrent and spinning band solvent system in accordance with the presently disclosed subject matter.

DETAILED DESCRIPTION

The presently disclosed subject matter now will be described more fully hereinafter with reference to the accompanying specification and Examples, in which representative embodiments are shown. The presently disclosed subject matter can, however, be embodied in many different forms and should not be construed as limited to the embodiments set forth herein. Rather, these embodiments are provided so that this disclosure will be thorough and complete, and will fully convey the scope of the presently disclosed subject matter to those skilled in the art.

The method of selecting a solvent or solvent blends for a particular use is a fine art, based on experience, trial and error, and intuition guided by such rules of thumb as "like dissolves like" and various definitions of solvent "strength." The solubility parameter concept introduced by Hildebrand, see Hildebrand, J. H., The Solubility of Non-Electrolytes (New York: Reinhold, 1936), and further refined by Hansen, see Hansen, C. M., The Three Dimensional Solubility Parameter-Key to Paint Component Affinities: I. Solvents Plasticizers, Polymers, and Resins, J. of Paint Technology, 39, 505 (1967), is often used for selecting a solvent, or formulating a solvent composition for a particular use. The successful implementation of the solubility parameter concept requires the knowledge of the chemical composition of the substrate (solute).

This is particularly challenging in case of asphalt binder (e.g., bitumen) because of its complex chemical structure that contains hundreds of molecules, which can vary according to the source of crude oil used to produce the bitumen, and according to the method of refinery used in its production. In general, bitumen contains three major classes of chemicals, namely, paraffins (normal and branched alkanes), naphthenes (cycloparaffins or cycloaliphatic compounds), and aromatics, including asphaltenes and resins. The ratios of these three major classes of chemicals present in bitumen differ from one type of bitumen to another according to the source of feedstock used to produce bitumen and the application of bitumen in road paving. The physical properties of bitumen are influenced by the variation of the ratios of these three major classes of chemicals. Bitumen with higher paraffin content tends to be softer and with less ability to adhere (less tacky) to inorganic materials (aggregates) surfaces, whereas, bitumen with higher asphaltene and resin content tends to be harder and tacky. Therefore, a proper selection of solvents should include chemical entities that are compatible with all three major classes of chemicals present in bitumen—that is, chemical entities with solubility parameter values close to the three major classes of chemicals present in bitumen. In this respect, solvent blends with optimum solubility parameters that matched that of bitumen were chosen.

Other alternative solvents for removing petroleum residue from a substrate include aliphatic or aromatic ester-containing solvent compositions. Aliphatic esters are obtained from naturally occurring fats and oils (vegetable oils and animal fats). These oils are chemically transformed into the methyl esters by treatment with an alcohol, such as methanol, and a base, such as sodium hydroxide, in a process known as transesterification. The methyl ester produced is often called biodiesel, as it is currently used as an environmentally benign substitute for diesel fuel. Biodiesel is not considered an efficient bitumen solvent, however, due to the inability of the aliphatic components of this ester to dissolve aromatic entities, e.g., asphaltenes and resins, present in bitumen. Aromatic esters are produced synthetically from natural and petrochemical sources, and are biodegradable, and generally recognized as safe (GRAS) chemicals by the U.S. Food and Drug Administration. These aromatic esters are considered more efficient than aliphatic ester solvents for removing petroleum residue (particularly bitumen) from a substrate. Neither aliphatic nor aromatic ester compositions are water-soluble, however. As such, the ester-containing solvent compositions would not be removed from a tool or truck bed treated with these solvents and subsequently rinsed with water. Therefore, a co-solvent and an emulsifying agent are needed to increase the water compatibility of the solvent formulation.

Co-solvents that are inherently biodegradable and have attained GRAS status are used to impart water miscibility to the solvents described by the presently disclosed subject matter. The co-solvents are chemicals characterized by their ability to be miscible with hydrophobic (water repelling) chemicals and with hydrophilic (having an affinity for water) chemicals at the same time. Alcohols, diols, and polyols are examples of these chemicals. The use of surfactants in the formulation enables the solvent to have better wetting ability to the applied surface, and allows the solvent and the removed bitumen dissolved therein to be easily removed by water when a water rinse is applied after applying the solvent on the tool or truck bed.

Surfactants are chemicals that contain hydrophobic and hydrophilic groups in the same molecule. The balance between the hydrophilic part of a surfactant and its hydrophilic part is often termed the hydrophilic-lipophilic balance (HLB). The HLB controls the solubility of the surfactant in water or oil, and its ability to stabilize emulsions. In general, according to Bancroft's Rule, see Bancroft. W. D., Journal of Physical Chemistry, 17, 507 (1913), water-soluble surfactants stabilize oil-in-water emulsions, and oil-soluble surfactants stabilize water-in-oil emulsions. The surfactants incorporated in the presently disclosed subject matter are inherently biodegradable, non-toxic, and pose no health or fire hazards.

The presently disclosed subject matter provides in some embodiments novel solvent compositions and methods for removing a petroleum residue (e.g., asphalt) from a substrate (e.g., a workpiece, such as a tool). In some embodiments, the presently disclosed compositions comprise a combination of an aromatic ester, an aliphatic ester, a co-solvent, an odor-masking agent, a cyclic terpene, and/or a nonionic surfactant, and/or a co-solvent or hydrotrope. Additionally, in some embodiments, the composition is water-soluble, non-toxic, and/or biodegradable, and/or has a high flash point. The presently disclosed compositions and methods can provide higher removal efficiencies of petroleum residue, such as asphalt, from a substrate (e.g., a workpiece, such as a tool, or a truck bed), as compared to currently available compositions and methods, while complying with the U.S. DOT and U.S. EPA requirements for an environmentally benign solvent.

The presently disclosed methods employ the presently disclosed compositions to remove petroleum residue from a substrate. A substrate can be an organic substrate, an inorganic substrate, or a combination thereof. The method comprises contacting the substrate with a solvent such that the petroleum residue separates from the substrate. The method can be employed, for example, to remove asphalt from a workpiece, such as a tool, or a truck bed.

The methods to remove petroleum residue from a substrate can be implemented using currently available equipment and systems. With respect to asphalt cleaning, for example, the solvent composition is typically sprayed under pressure on the residue-containing equipment or workpiece, such as a tool. In this case the tool can be placed on a perforated grid capable of filtering the solvent from the inorganic solvent-insoluble contaminants.

In some embodiments, the method for removing petroleum residue from a substrate further comprises recycling the solvent composition after it has been used to remove the petroleum residue from the substrate, for example, asphalt paving equipment.

I. Compositions

Disclosed herein is a water-soluble composition for removing petroleum residue from a substrate, e.g., a workpiece such as a tool. In some embodiments, the composition comprises:

(a) from about 10% to about 60% by weight of an aromatic ester;
(b) from about 30% to about 60% by weight of an aliphatic ester;
(c) from 0% to about 15% by weight of a co-solvent;
(d) from 0% to about 10% by weight of one of a cyclic terpene and a terpenoid;
(e) from 0% to about 1% by weight of an odor-masking agent; and
(f) from 0% to about 20% by weight of a nonionic surfactant.

Other additives can be added to the composition, including, but not limited to, corrosion inhibitors, thickening agents, buffer solutions, water, and biocides without altering the basic specifications required by the U.S. DOT for an environmentally benign solvent.

In some embodiments, the composition is non-toxic, biodegradable and/or has a flash point (closed cup) greater than at about 60° C. In some embodiments, the composition further comprises water. In some embodiments, the composition comprises an aqueous solution. The presently disclosed composition can provide higher removal efficiencies of petroleum residue, such as asphalt, from a substrate, as compared to compositions comprising either an aromatic ester or an aliphatic ester only. Without being limited to a particular theory of operation, this higher removal efficiency is attained because of the new solubility parameter value of the solvent composition that is closer to that of the average solubility parameter of bitumen. Such a solubility parameter is not attainable by a single solvent, and the solvent composition is thus carefully formulated to meet such an optimum solubility parameter value. The presently disclosed subject matter provides a novel formulation of several chemical entities that are biodegradable, and have some efficiency in dissolving bitumen. The accumulative efficiency of the formulation disclosed herein, the careful balance between the components, and the compliance with all the U.S. DOT criteria required for a biodegradable solvent represent the core of the presently disclosed subject matter.

Unless otherwise defined, all technical and scientific terms used herein have the same meaning as commonly understood by one of ordinary skill in the art to which this presently described subject matter belongs. All publications, patent applications, patents, and other references mentioned herein are incorporated by reference in their entirety.

Throughout the specification and claims, a given chemical formula or name shall encompass all optical and stereoisomers, as well as racemic mixtures where such isomers and mixtures exist.

While the following terms are believed to be well understood by one of ordinary skill in the art, the following definitions are set forth to facilitate explanation of the invention.

As used herein, the term "about," when referring to a value or to an amount of mass, weight, time, volume, concentration or percentage is meant to encompass variations of ±20% or ±10%, in another example ±5%, in another example ±1%, and in still another example ±0.1% from the specified amount, as such variations are appropriate to perform the disclosed method or to employ the disclosed composition.

The term "water-soluble" refers to a substance capable of dissolving in water to form an isotropic solution.

The term "non-toxic" refers to the relative toxicity of a substance as measured by the $LD_{50}$ (lethal dose 50 percent kill). For example, the oral $LD_{50}$ in rats of the individual components in representative embodiments of the solvent composition described herein are: biodiesel (17.4 g/kg); and butyl carbitol (6,560 mg/kg). These individual components are considered "practically non-toxic," with a toxicity rating of 5 on the Hodge and Sterner scale. See Hodge, H. C. and Sterner, J. H., Am Indus. Hyg. A. Quart. 10, 93-96 (1949); Hodge, H. C. and Sterner, J. H., Combined Tabulation of Toxicity Classes, in Handbook of Toxicology (Spector, W. S., Ed., W. B. Saunders Co., Philadelphia), Vol. 1 (1956). The term "non-toxic" also encompasses "Generally Recognized As Safe solvents", which are also known in the art as "GRAS solvents".

The term "biodegradable" refers to a substance that can be chemically degraded via natural effectors, such as bacteria, weather, plants or animals. Relative biodegradability can be determined by use of the UK Offshore Chemical Notification Scheme (OCNS) rating scale. Under the OCNS rating scale, category E is the least toxic category, whereas category A is the most toxic. Any rating from category C to E typically signifies that the material can be readily biodegradable and can be nonbioaccumulative. See, e.g., Offshore Chemical Notification Scheme, Centre for Environment, Fisheries and Aquaculture Science (CEFAS), United Kingdom Department for Environment, Food and Rural Affairs, for a description of chemical ratings.

The term "aromatic" refers to an organic compound containing one or more unsaturated carbon rings characteristic of the benzene series and related organic groups.

The term "aliphatic" refers to an organic compound wherein the carbon and hydrogen atoms are arranged in saturated or unsaturated straight or branched chains, including alkanes, alkenes and alkynes, wherein representative alkanes, alkenes, and alkynes are provided in the definition of the term "alkyl" herein.

The term "ester" refers to an organic compound of the general formula:

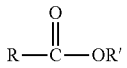

wherein R and R' are the same or different aliphatic or aromatic groups. The term "aliphatic ester" refers to an ester wherein "R" and/or "R" is an aliphatic group as defined herein. The term "aromatic ester" refers to an ester wherein "R" and/or "R" is an aromatic group as defined herein. In some embodiments, the aromatic ester is a benzoic acid ester, i.e., a benzoate, wherein the term "benzoate" refers to a salt or ester of benzoic acid. In preferred embodiments, the benzoic acid ester is an alkylated benzoic acid ester.

The term "alkylated" refers to a chemical compound containing one or more alkyl groups. As used herein the term "alkyl" refers to $C_{1-20}$ inclusive, e.g., an alkyl group of 1, 2, 3, 4, 5, 6, 7, 8, 9, 10, 11, 12, 13, 14, 15, 16, 17, 18, 19 or 20 carbons, linear (i.e., "straight-chain"), branched, or cyclic, saturated or unsaturated (i.e., alkenyl and alkynyl) hydrocarbon chains, including for example, methyl, ethyl, propyl, isopropyl, butyl, isobutyl, tert-butyl, pentyl, hexyl, octyl, ethenyl, propenyl, butenyl, pentenyl, hexenyl, octenyl, butadienyl, propynyl, butynyl, pentynyl, hexynyl, heptynyl, and allenyl groups. "Branched" refers to an alkyl group in which a lower alkyl group, such as methyl, ethyl or propyl, is attached to a linear alkyl chain. "Lower alkyl" refers to an alkyl group having 1 to about 8 carbon atoms, e.g., an alkyl group of 1, 2, 3, 4, 5, 6, 7 or 8 carbons (i.e., a $C_{1-8}$ alkyl). "Higher alkyl" refers to an alkyl group having about 10 to about 20 carbon atoms, e.g., alkyl groups of 10, 11, 12, 13, 14, 15, 16, 17, 18, 19 or 20 carbons. In some embodiments, "alkyl" refers, in particular, to $C_{1-8}$ straight-chain alkyls, e.g., straight-chain alkyls of 1, 2, 3, 4, 5, 6, 7 or 8 carbons. In other embodiments, alkyl refers, in particular, to $C_{1-8}$ branched-chain alkyls, e.g., branched-chain alkyls of 1, 2, 3, 4, 5, 6, 7 or 8 carbons.

Alkyl groups can optionally be substituted with one or more alkyl group substituents, which can be the same or different. The term "alkyl group substituent" includes but is not limited to alkyl, halo, arylamino, acyl, hydroxyl, aryloxyl, alkoxyl, alkylthio, arylthio, aralkyloxyl, aralkylthio, carboxyl, alkoxycarbonyl, oxo, and cycloalkyl. There can be optionally inserted along the alkyl chain one or more oxygen, sulfur or substituted or unsubstituted nitrogen atoms, wherein the nitrogen substituent is hydrogen, lower alkyl (also referred to herein as "alkylaminoalkyl"), or aryl.

The solvent composition can comprise one or more alkylated benzoic acid esters. Exemplary alkylated benzoic acid esters include, without limitation, methyl benzoic acid ester, ethyl benzoic acid ester, n-propyl benzoic acid ester, isobutyl benzoic acid ester, n-butyl benzoic acid ester, tert-butyl benzoic acid ester, isomers of pentyl benzoic acid ester, isopropyl benzoic acid ester, and mixtures thereof.

In some embodiments, the alkylated benzoic acid ester is isopropyl benzoic acid ester, i.e., isopropyl benzoate (hereinafter "IPB"). In some embodiments, the solvent composition comprises at least about 10 to 60 percent by weight of an aromatic ester. In some embodiments, the solvent composition comprises at least about 40 to about 50 percent by weight of an aromatic ester.

Representative aromatic ester compounds also include, without limitation, salicylic acid esters, cinnamic acid esters, propionic acid esters, butyric acid esters, pentanoic acid esters, and hexanoic acid esters.

Representative salicylic acid esters include, without limitation, methyl salicylate, ethyl salicylate, n-propyl salicylate, isobutyl salicylate, n-butyl salicylate, tert-isomers salicylate, isomers of pentyl salicylate, isomers of hexyl salicylate, isomers of heptyl salicylate, isopropyl salicylate, and mixtures thereof.

Representative cinnamic acid esters include, without limitation, methyl cinnamate, ethyl cinnamate, n-propyl cinnamate, isobutyl cinnamate, n-butyl cinnamate, tert-butyl cinnamate, isomers of pentyl cinnamate, isomers of hexyl cinnamate, isomers of heptyl cinnamate, isopropyl cinnamate, benzyl cinnamate, and mixtures thereof.

Representative propionic acid esters include, without limitation, phenyl propionate, benzyl propionate, hydroxyphenyl propionate, methyl phenyl propionate, isobutyl phenyl propionate, n-butyl phenyl propionate, tert-butyl phenyl propionate, isomers of pentyl phenyl propionate, isomers of hexyl phenyl propionate, isomers of heptyl phenyl propionate, isopropyl phenyl propionate, and mixtures thereof.

Representative butyric acid esters include, without limitation, phenyl butyrate, benzyl butyrate, hydroxyphenyl butyrate, methyl phenyl butyrate, isobutyl phenyl butyrate, n-butyl phenyl butyrate, tert-butyl phenyl butyrate, isomers of pentyl phenyl butyrate, isomers of hexyl phenyl butyrate, isomers of heptyl phenyl butyrate, isopropyl phenyl butyrate, and mixtures thereof.

Representative pentanoic acid esters include, without limitation, phenyl pentanoate, benzyl pentanoate, hydroxyphenyl pentanoate, methyl phenyl pentanoate, isobutyl phenyl pentanoate, n-butyl phenyl pentanoate, tert-butyl phenyl pentanoate, isomers of pentyl phenyl pentanoate, isomers of hexyl phenyl pentanoate, isomers of heptyl phenyl pentanoate, isopropyl phenyl pentanoate, and mixtures thereof.

Representative hexanoic acid esters include, without limitation, phenyl hexanoate, benzyl hexanoate, hydroxyphenyl hexanoate, methyl phenyl hexanoate, isobutyl phenyl hexanoate, n-butyl phenyl hexanoate, tert-butyl phenyl hexanoate, isomers of pentyl phenyl hexanoate, isomers of hexyl phenyl hexanoate, isomers of heptyl phenyl hexanoate, isopropyl phenyl hexanoate, and mixtures thereof.

The solvent composition can comprise one or more aliphatic esters. Representative aliphatic esters comprise alkyl (including, but not limited to, methyl, ethyl, propyl, isopropyl, butyl, isobutyl, tert-butyl, pentyl, hexyl, octyl, 2-ethylhexyl, and longer chain alkyl groups) esters of varying hydrocarbon chain lengths and degrees of unsaturation derived from aliphatic organic acids, which include, but are not limited to: acetic, propionic, butyric, pentanoic, hexanoic, 2-ethylhexanoic, heptanoic, octanoic, nonanoic, capric, undecanoic, lauric, tridecanoic, myristic, pentadecanoic, palmitic, margaric, stearic, nonadecanoic, arachidic, henicosanoic, behenic, tricosanoic, lignoceric, myristoleic, palmitoleic, oleic, linoleic, linolenic, erucic, maleic, fumaric, oxalic, malonic, succinic, glutaric, adipic, pimelic, suberic, azelaic, sebacic acids and isomers and mixtures thereof.

In some embodiments, the aliphatic ester is a fatty acid alkyl ester. The term "fatty acid alkyl ester" refers to alkyl esters with a chain length of 12 to 22 carbons, e.g., 12, 13, 14, 15, 16, 17, 18, 19, 20, 21 or 22 carbons. In some embodiments, the fatty acid alkyl ester is a fatty acid methyl ester. In some embodiments, the fatty acid methyl ester is biodiesel. The term "biodiesel" refers to mono-alkyl esters of long-chain fatty acids derived from vegetable oils, such as soybean oil, or animal fats, or recycled frying vegetable oil wastes designated B100, and meeting the requirements of ASTM D 6751. A typical profile of methyl esters of soybean oil is: 12% palmitic ($C_{15}H_{31}CO_2CH_3$); 5% stearic ($C_{17}H_{35}CO_2CH_3$); 25% oleic ($C_{17}H_{33}CO_2CH_3$); 52% linoleic ($CH_3(CH_2)_4CH{=}CHCH_2CH{=}CH(CH_2)_7CO_2CH_3$); and 6% linolenic ($CH_3(CH_2CH{=}CH)_3(CH_2)_7CO_2CH_3$). In some embodiments, the solvent composition comprises at least about 30 to about 60 percent by weight of an aliphatic ester. In some embodiments, the solvent composition comprises at least about 40 to about 50 percent by weight of an aliphatic ester.

The term "co-solvent" is defined herein as any substance, which upon addition to a composition increases the solubility of the composition in a particular solvent, such as water. In some embodiments, the co-solvent is a hydrotrope. The term "hydrotrope" refers to a chemical substance that causes other organic substances that are only slightly water-soluble to become more easily dissolved in water. In some embodiments, the hydrotrope is a diethylene glycol ether. In some embodiments, the diethylene glycol ether is butyl carbitol. In some embodiments, the solvent composition comprises at least from about 5 to about 15 percent by weight of a co-solvent. In some embodiments, the solvent composition comprises at least about 10 percent by weight of a co-solvent.

The term "cyclic terpene" refers to a cyclic aliphatic compound comprising two five-carbon isoprene (2-methylbuta-1,3-diene) units. As such, a terpene possesses a degree of unsaturation, and side chain substitutent groups, for example, an alkyl or an alkenyl side chain as defined herein, resulting in a general chemical formula of $C_{10}H_{16}$. An example of a cyclic terpene is d-limonene, which can be produced, for example, from orange peels. A cyclic terpene can further comprise alkyl-substituent groups as defined herein.

The term "terpenoid" refers to a class of naturally occurring or synthetically produced compounds comprising a carbon backbone made up of five-carbon isoprene (2-methylbuta-1,3-diene) units. The carbon backbone comprises $5_n$ carbon atoms, wherein n is an integer from 1 to 8. The isoprene units can be assembled to form multicylic structures and functionalized, for example, by the introduction of oxygen (or other heteroatoms), to form, for example, a hydroxyl or a ketone substituent group.

In some embodiments, the solvent composition is substantially free of cyclic terpenes. Accordingly, in embodiments that use little if any cyclic terpene, the solvent composition is non-flammable and has high flash point. In other embodiments, the solvent composition can contain at least from 0 to about 20 percent by weight of a cyclic terpene.

The term "odor-masking agent" refers to a substance that masks an unpleasant odor associated with a chemical composition. In some embodiments, the odor-masking agent is a fragrance. In preferred embodiments, the fragrance is a lemon tart fragrance. In some embodiments, the composition comprises from about 0.01 to about 1 percent by weight of an odor-masking agent. In some embodiments, the solvent composition is substantially free of odor masking agents.

The term "surfactant" refers to a substance capable of reducing the surface tension of a liquid in which it is dissolved. A "nonionic surfactant" refers to a surfactant that does not contain a charged moiety. A nonionic surfactant typically contains a hydrophobic hydrocarbon chain and a hydrophilic group. A nonionic surfactant typically is biodegradable and exhibits a low toxicity.

In some embodiments, the solvent composition is substantially free of surfactant. Accordingly, in embodiments that use little if any surfactant, the solvent composition is non-foaming. In other embodiments, the solvent composition can contain at least from 0 to about 20 percent by weight of a nonionic surfactant.

In some embodiments, the nonionic surfactant is an alkoxylated triglyceride. The term "triglyceride" refers to a naturally occurring ester of three fatty acids and glycerol ($C_3H_8O_3$). The term "alkoxylated" refers to a chemical compound containing one or more alkoxyl groups as defined herein. The term "alkoxyl" refers to an alkyl-O— group, wherein alkyl is as previously described. The term "alkoxyl" as used herein can refer to $C_{1-20}$ inclusive, e.g., a hydrocarbon chain of 1, 2, 3, 4, 5, 6, 7, 8, 9, 10, 11, 12, 13, 14, 15, 16, 17, 18, 19 or 20 carbons, linear, branched, or cyclic, saturated or unsaturated oxo-hydrocarbon chains, including, for example, methoxy, ethoxy, propoxy, isopropoxy, butoxy, t-butoxy, and pentoxy.

In some embodiments, the alkoxylated triglyceride is an ethyoxylated Castor oil. The term "Castor oil" refers to an oil extracted from the seeds of the castor-oil plant. In some embodiments, the ethyoxylated Castor oil is polyoxyethylene (20) castor oil (ether, ester).

In some embodiments, the nonionic surfactant is an alkoxylated amide. The term "amide" refers to a chemical compound containing the group:

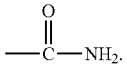

In some embodiments, the alkoxylated amide is an alkoxylated hydrogenated tallow amide. The term "tallow" refers to fat obtained from the bodies of cattle, sheep, or horses, or any various similar fats, such as those obtained from plants, which contain glycerides of $C_{16}$-$C_{18}$ fatty acids, in some embodiments. In preferred embodiments, the alkoxylated hydrogenated tallow amide is a polyoxyethylene (13) hydrogenated tallowalkylamide.

In some embodiments, the solvent composition comprises about 50% by weight of an aromatic ester; about 40% by weight of an aliphatic ester; about 10% by weight of a co-solvent; and about 0.1% by weight of an odor-masking agent.

In some embodiments, the solvent composition comprises about 40% by weight of an aromatic ester; about 50% by weight of an aliphatic ester; about 10% by weight of a co-solvent; and about 0.1% by weight of an odor-masking agent.

In some embodiments, the solvent composition comprises about 40% by weight of an aromatic ester; about 40% by weight of an aliphatic ester; about 10% by weight of a co-solvent; about 0.1% by weight of an odor-masking agent; and about 10% by weight of a nonionic surfactant.

In some embodiments, the solvent composition comprises about 30% by weight of an aromatic ester; about 40% by weight of an aliphatic ester; about 10% by weight of a co-solvent; about 0.1% by weight of an odor-masking agent; and about 20% by weight of a nonionic surfactant.

In some embodiments, the solvent composition comprises about 30% by weight of an aromatic ester; about 50% by weight of an aliphatic ester, about 10% by weight of a cyclic terpene, and about 10% by weight of a nonionic surfactant.

In some embodiments, the solvent composition further comprises water. In some embodiments, the solvent composition comprises an aqueous solution. In some embodiments, the solvent composition comprises about a 10% aqueous solution. In other embodiments, the solvent composition comprises about a 20% aqueous solution.

The solvent composition described herein is, in some embodiments, environmentally friendly in that it can be water-soluble, nontoxic, and readily biodegradable. In representative embodiments, the composition has an OCNS rating of category E, which is the least toxic category of the OCNS rating scheme. Compositions with a category E rating are considered to be readily biodegradable and non-bioaccumulative. Further, in some embodiments, the composition has a flash point (closed cup), i.e., the lowest temperature at which the vapor of a combustible liquid can be made to ignite momentarily in air, greater than about 60° C.

II. Novel Methods

In another aspect, provided is a method of removing petroleum residue from a substrate (e.g., removing asphalt from workpieces such as tools). The method comprises contacting the substrate with the solvent composition described herein such that the petroleum residue separates from the substrate. In some embodiments, the petroleum residue is dissolved in the composition. The term "dissolved in the composition" is to be broadly construed to refer to the petroleum residue being solubilized, suspended or entrained in the composition. Accordingly, the term is intended to encompass all embodiments in which the petroleum residue could be fully soluble, partially soluble, or insoluble in the composition.

The term "substrate" is to be construed broadly and refers to various liquid materials, solid materials, and combinations thereof, including, without limitation, semi-liquid and or semi-solid materials, which contain the petroleum residue to be removed.

Inorganic and organic substrates, as well as alloys and composites thereof, are well within the scope of the presently described subject matter. The term "inorganic substrate" is to be construed broadly and refers to substrates comprising various metallic and ceramic materials.

In some embodiments, exemplary substrates can be present in and/or on a number of articles of manufacture used in the petroleum refining, storage, and transportation fields, including, without limitation, cleaning storage tanks, electrostatic desalters, API separators, slop oil tanks, electrostatic precipitators, crude oil storage tanks, gas separators, pipelines and reservoirs and extraction of bitumen from tar sands.

In some embodiments, exemplary substrates can be present in and/or on equipment or a workpiece, such as a tool, used in highway and road construction.

For the purposes of the presently disclosed subject matter, the term "petroleum residue" is to be broadly construed and includes, without limitation, material that is typically present in various applications that are related to petroleum products, e.g., crude oils, asphaltic residues, coal tar, petroleum sludges and tank bottoms, and any by-products. For the purposes of the presently disclosed subject matter, "petroleum residue" encompasses heavy petroleum fractions, which can have a boiling point of at least about 150° C. or about 200° C., or at least about 340° C., and can include a mixture of paraffinic and aromatic hydrocarbons along with heterocyclic compounds containing sulfur, nitrogen and oxygen. Asphalt, as well as residues and related materials thereof, also is construed as being encompassed by the term "petroleum residue" for the purposes of the presently disclosed subject matter.

In some embodiments, the petroleum residue removed from a substrate is asphalt. As understood by one skilled in the art, asphalt is a product of crude oil refining processing, giving rise to a cement-like material containing bitumen. In an exemplary process, crude oil is distilled in a primary flash distillation column; the residue of this process is introduced to an atmospheric distillation column. The residue of the atmospheric distillation process is typically distilled under reduced pressure, e.g., vacuum distillation, and the residue is termed asphalt. The asphalt produced from the vacuum distillation of crude oil typically has softening points ranging from about 25° C. to about 55° C. Asphalts of intermediate softening points can be made, for example, by blending with higher and lower softening point asphalts. If the asphalt has a low softening point, it can be hardened by further distillation with steam or by oxidation, e.g., air blowing. Furthermore, asphalt also can be produced by propane deasphalting in the production of lubricating oils from crude oil residua. The asphalt produced by propane deasphalting can have a softening point of about 90° C. Softer grades can be made by blending the hard asphalt with the extract obtained in the solvent treatment of lubricating oils.

In general, "asphalt" can be defined as the residue of mixed-base and asphalt-base crude oils. Asphalt is difficult to distill even under the highest vacuum, because the temperatures used tend to promote formation of coke. Asphalts have complex chemical and physical compositions, which usually vary with the source of the crude oil. Asphalts generally comprise dispersions of particles, called asphaltenes, in a high-boiling fluid comprising oil and resins. The nature of the asphalt is often determined by such factors as the nature of the medium, e.g., paraffinic or aromatic, as well as the nature and proportion of the asphaltenes and of the resins. The polar and fused ring portions of the asphaltenes have been suggested to be lyophobic, that is, they lack an affinity for the medium in which they are dispersed. In contrast, the resins are considered to be lyophilic, that is, they exhibit an affinity for the medium in which they are dispersed. The interaction of the resins with the asphaltenes is believed to be responsible for asphaltene solvation or dispersion, which seems to exercise marked control on the quality of the asphalt. The asphaltenes vary in character, but typically are of sufficiently high molecular weight or aggregate size to require solvation or dispersion by the resins.

For the purposes of the presently disclosed subject matter, the term "asphalt" includes crude asphalt, as well as, without limitation, the following finished products: cements, fluxes, the asphalt content of emulsions, and petroleum distillates blended with asphalts to make cutback asphalts. Cutbacks and emulsions compose liquid asphalts. A cutback can be defined as a cement that has been liquefied with solvents, such as, for example, naptha or gasoline or kerosene. Emulsified asphalts are mixtures of asphalt cement, water and an emulsifying agent.

Accordingly, an asphalt-related material can be removed from a substrate in some embodiments of the presently disclosed subject matter. In some embodiments, the petroleum residue removed from the substrate is bitumen. Bitumen is the predominant constituent of petroleum residues, including asphalt. As known in the art, "bitumen" is defined as a mixture of hydrocarbons occurring in the petroleum, and is a component of asphalt and tar that are used, for example, for surfacing roads.

In some embodiments, the petroleum residue removed from a substrate can be characterized as asphaltenes, which might or might not be present as part of the bitumen. The term "asphaltenes" is defined to include components of the high boiling point fraction of the crude oil, which are composed of polynuclear aromatic hydrocarbons of molecular weights ranging from about 500 to about 2000 daltons or greater and aggregate molecular weights of up to about 20,000 daltons joined by alkyl chains. See, e.g., Hawley's Condensed Chemical Dictionary, 12.sup.th Ed. (Richard J. Lewis, Sr., Ed.) (1993), at 101. Asphaltenes are understood to include the toluene-soluble fraction of crude oil that is insoluble in n-heptane or n-pentane.

Other components, such as, for example, oils, waxes, resins, pitch, tar and tack also are typically present in petroleum residue.

The petroleum residue can be "on" the surface of a substrate, can be embedded, entrained or contained within a substrate, or can be partially embedded, entrained or contained within a substrate.

Use of the solvent composition disclosed herein to remove petroleum residue from a substrate can be accomplished by using currently available equipment and systems. With respect to asphalt cleaning, for example, the solvent composition is typically sprayed under pressure on the residue-containing equipment or workpiece, such as a tool, which is placed on a perforated grid capable of filtering the solvent from the inorganic solvent-insoluble contaminants. In some embodiments, the application of the solvent composition typically takes place from about 1 to about 20 minutes, at a temperature ranging from about 10° C. to about 50° C.

The presently disclosed composition can provide higher removal efficiencies of petroleum residue, such as asphalt, from a substrate, as compared to compositions comprising either an aromatic ester or an aliphatic ester only. In some embodiments, the contacting step comprises removing from about 16 to about 18.5 percent by weight of bitumen based on the bitumen present in the petroleum residue, although it should be appreciated that other amounts can be removed. In some embodiments, the composition is water-soluble, non-toxic, and/or biodegradable, and/or has a high flash point.

In some embodiments, the petroleum residue is solubilized, suspended, or entrained in the solvent composition after the petroleum residue is removed from the substrate. To comply with the EPA regulations and to further rid the environment from potential wastes, the presently disclosed subject matter provides a method for recycling the solvent composition after it has been used to remove petroleum residue, e.g., bitumen, from a substrate, e.g., asphalt paving equipment.

The method for separating the solvent composition from the petroleum residue solubilized, suspended, or entrained in the solvent composition comprises:

(a) filtering the composition;
(b) pumping the filtered composition into a separation column; and
(c) subjecting the filtered composition to a compressed gas.

In some embodiments, the solvent composition is first filtered to remove inorganic particulate matter from the composition. In some embodiments, the filtered composition is then separated from the petroleum residue, e.g., bitumen, by using a countercurrent separation column in which the composition is subjected to compressed gas, such as ammonia or carbon dioxide or mixtures thereof. In some embodiments, the compressed gas comprises a mixture of ammonia and carbon dioxide at a ratio ranging from about 1:10 to about 10:1 by volume ammonia:carbon dioxide.

In some embodiments, without being limited to a particular theory, the compressed gas functions as an anti-solvent for the petroleum residue, e.g., bitumen, by swelling the organic solvent composition thereby rendering the organic solvent composition incapable of dissolving the petroleum residue. Hence, the petroleum residue separates from the solvent composition.

In some embodiments, the solvent composition and the compressed gas are separated from each other by depressurization. In some embodiments, the solvent composition is separated from the compressed gas in a depressurization unit, wherein the pressure is decreased to release the gas from the chamber, thereby leaving the solvent behind. This method is often termed gas anti-solvent separation (GAS).

In some embodiments, the method further comprises purifying the solvent composition by use of a spinning band distillation column. Accordingly, based on the composition of the solvent formulation, the countercurrent separation method alone or the countercurrent separation method followed by fractional distillation using a spinning band distillation column are utilized to recycle the used solvent compositions. A schematic depiction of the process is shown in FIG. 1.

III. Representative Applications

The presently disclosed compositions and methods can be used for removing petroleum residue from a substrate in a number of varied applications. Exemplary applications include, without limitation:

Agricultural applications, such as: cattle sprays, dampproofing and waterproofing buildings and structures, disinfectants, fence post coating, mulches, mulching paper, paved barn floors, barnyards, feed platforms, and the like, protecting tanks, vats, and the like, protection for concrete structures, tree paints, water and moisture barriers (above and below ground), wind and water erosion control, and weather modification areas.

Buildings and building applications, such as: floors, e.g., dampproofing and waterproofing buildings and structures, floor compositions, tiles and coverings, insulating fabrics, papers, step treads; roofing, e.g., building papers, built-up roof adhesives, felts, primes, caulking compounds, cement waterproofing compounds, cleats for roofing, glass wool compositions, insulating fabrics, felts, papers, joint filler compounds, laminated roofing, shingles, liquid roof coatings, plastic cements, and shingles; walls, siding, ceilings, e.g., acoustical blocks, papers, dampproofing coatings, compositions, insulating board, fabrics, felt, paper, joint filler compounds, masonry coatings, plaster boards, putty, asphalt, siding compositions, soundproofing, stucco base, and wallboard; hydraulics and erosion control applications, e.g., canal linings, sealants, catchment areas, basins, dam groutings, dam linings, protection, dike protection, ditch linings, drainage gutters, structures, embankment protection, groins, jetties, levee protection, mattresses for levee and bank protection, membrane linings, waterproofing, ore leaching pads, reservoir linings, revetments, sand dune stabilization, sewage lagoons, oxidation ponds, swimming pools, waste ponds, and water barriers.

Industrial applications, such as: aluminum oil compositions using asphalt backed felts, conduit insulation, lamination, insulating boards, paint compositions, felts, brake linings, clutch facings, degreaser/cleaner for heavy machinery, degreaser/cleaner for heavy machinery parts, removing industrial oils, including but not limited to hydraulic oils, compressor oils, turbine oils, bearing oils, gear oils, transformer (dielectric) oils, refrigeration oils, metalworking oils, and railroad oils, from heavy machinery, degreaser/cleaner for automobiles and automotive parts, degreaser/cleaner for motorcycles and motorcycle parts, removing used motor oils, including but not limited to engine lubricating oil, vehicle crankcase oil, transmission fluids, and gearbox and differential oils, from used oil filters or automotive or motorcycle parts, removing tar from heavy machinery, automobiles, motorcycles, and the like, floor sound deadeners, friction elements, insulating felts, panel boards, shim strips, tacking strips, underseal, electrical, armature carbons, windings, battery boxes, carbons, electrical insulating compounds, papers, tapes, wire coatings, junction box compounds, embalming, etching compositions, extenders, rubber, and other compositions; explosives, fire extinguisher compounds, joint fillers, lap cement, lubricating grease, pipe coatings, dips, joint seals, plastic cements, plasticizers, preservatives, printing inks, well drilling fluid, wooden cask liners, impregnated, treated materials, armored bituminized fabrics, burlap impregnation, canvas treating, carpeting medium, deck cloth impregnation, fabrics, felts, mildew prevention, packing papers, pipes and pipe wrapping, planks, rugs, asphalt base, saw dust, cork, and asphalt compositions; textiles, waterproofing, tiles, treated leather, wrapping papers, paints, varnishes, etc., acid-proof enamels, mastics, varnishes, acid-resistant coatings, air-drying paints, varnishes, anti-corrosive and anti-fouling paints, anti-oxidants and solvents, base for solvent compositions, baking and heat resistant enamels, boat deck sealing compound, lacquers, japans, marine enamels, belting, blasting fuses, briquette binders, burial vaults, casting molds, clay articles, clay pigeons, depilatory, expansion joints, flower pots, foundry cores, friction tape, gaskets, imitation leather, mirror backing, phonograph records, rubber, molded compounds, show fillers, soles, and table tops; airport runways, taxiways, aprons, etc., asphalt blocks, brick fillers, bridge deck surfacing, crack fillers, curbs, gutters, drainage ditches, floors for buildings, warehouses, garages, etc., highways, roads, streets, shoulders, parking lots, driveways, pcc underseal, roof-deck parking, sidewalk, footpaths, soil stabilization, ballast-treatment, curve lubricant, dust laying, paved ballast, sub-ballast, paved crossings, freight yards, station platforms, rail fillers, railroad ties, tie impregnating, stabilization, paved surfaces for: dance pavilions, drive-in movies, gymnasiums, sports arenas, playgrounds, school yards, race tracks, running tracks, skating rinks, swimming and wading pools, tennis courts, handball courts, crude oil spills, wildlife cleanup, and tar sand separation.

EXAMPLES

The following Examples have been included to illustrate representative embodiments of the presently disclosed subject matter. Certain aspects of the following Examples are described in terms of techniques and procedures found or contemplated to work well in the practice of presently disclosed subject matter. In light of the present disclosure and the general level of skill in the art, those of skill will appreciate that the following Examples are intended to be exemplary only and that numerous changes, modifications, and alterations can be employed without departing from the spirit and scope of the presently disclosed subject matter.

The North Carolina Department of Transportation (NCDOT) has developed specifications for an asphalt solvent testing and approval program. See Whitley, A. B., IV, Developing an Asphalt Solvent Testing and Approval Program in North Carolina, Transportation Research Circular (Transportation Research Board of the National Academies, Washington, D.C.), No. E-0052, (July 2003) at 133-141. The NCDOT specification for asphalt solvents has four primary components: (1) the solvent shall be biodegradable; (2) the solvent shall not contain any chlorinated solvents, caustics, or acids; (3) the solvent shall have a closed-cup flash point greater than 140° F. (60° C.); and (4) the solvent shall have a solvent effect on asphalt.

Under the NCDOT specifications, the flash point of the composition is determined by ASTM method D-93 (Pensky-Martens Closed Cup). Further, the flash point is to be reported as the average of three flash point results determined at varying temperatures. Also, under the NCDOT specifications, to determine if the solvent is environmentally friendly and biodegradable, the asphalt solvent compositions will be screened using EPA Method 8260B. A solvent will not be approved for use if any quantity of a compound listed in EPA Method 8260B is detected in the sample tested. A listing of exemplary compounds determined by EPA Method 8260B is provided in Table 1.

Further, under the NCDOT specifications, the performance of the solvent is tested by the method provided in Example 1. The solvent must perform as well as diesel fuel, or better, by removing at least 16% of the asphalt sample in this test method to be approved for use.

TABLE 1

Table 1. Exemplary Compounds Determined by EPA Method 8260B.

| | | |
|---|---|---|
| Acetone | Acetonitrile | Acrolein (Propenal) |
| Acrylonitrile | Ally alcohol | Allyl chloride |
| Benzene | Benzyl chloride | Bis(2-chloroethy)sulfide |
| Bromoacetone | Bromochloromethane | Bromodichloromethane |
| 4-Bromofluorobenzene (surr) | Bromoform | Bromomethane |
| n-Butanol | 2-Butanone (MEK) | t-Butyl alcohol |
| Carbon disulfide | Carbon tetrachloride | Chloral hydrate |
| Chlorobenzene | Chlorobenzene-$d_5$ (IS) | Chlorodibromomethane |
| Chloroethane | 2-Chloroethanol | 2-Chloroethyl vinyl ether |
| Chloroform | Chloromethane | Chloroprene |
| 3-Chloropropionitrile | Crotonaldehyde | 1,2-Dibromo-3-chloropropane |
| 1,2-Dibromoethane | Dibromomethane | 1,2-Dichlorobenzene |
| 1,3-Dichlorobenzene | 1,4-Dichlorobenzane | 1,4-Dichlorobenzene-$d_4$ (IS) |
| cis-1,4-Dichloro-2-butene | trans-1,4-Dichloro-2-butene | Dichlorodifluoromethane |
| 1,1-Dichloroethane | 1,2-Dichloroethane | 1,2-Dichloroethane-$d_4$ (surr) |
| 1,1-Dichloroethene | trans-1,2-Dichloroethene | 1,2-Dichloropropane |
| 1,3-Dichloro-2-propanol | cis-1,3-Dichloropropene | trans-1,3-Dichloropropene |
| 1,2,3,4-Diepoxybutane | Diethyl ether | 1,4-Difluorobenzene (IS) |
| 1,4-Dioxane | Epichlorohydrin | Ethanol |
| Ethyl acetate | Ethylbenzene | Ethylene oxide |
| Ethyl methacrylate | Fluorobenzene (IS) | Hexachlorobutadiene |
| Hexachloroethane | 2-Hexanone | 2 -Hydroxypropionitrile |
| Iodomethane | Isobutyl alcohol | Isopropybenzene |
| Malononitrile | Methacrylanitrile | Methanol |
| Methylene chloride | Methyl methacrylate | 4-Methyl-2-pentanone (MIBK) |
| Naphthalene | Nitrobenzene | 2-Nitropropane |
| N-Nitroso-di-n-butylamine | Paraldehyde | Pentachloroethane |
| 2-Pentanone | 2-Picoline | 1-Propanol |
| 2-Propanol | Propargyl alcohol | β-Propiolactone |
| Propionitrile (ethyl cyanide) | n-Propylamine | Pyridine |
| Styrene | 1,1,1,2-Tetrachloroethane | 1,1,2,2-Tetrachloroethane |
| Tetrachloroethene | Toluene | Toluene-$d_8$ (surr) |
| o-Toluidine | 1,2,4-Trichlorobenzene | 1,1,1-Trichloroethane |
| 1,1,2-Trichloroethane | Trichloroethene | Trichlorofluoromethane |

TABLE 1-continued

Table 1. Exemplary Compounds Determined by EPA Method 8260B.

| | | |
|---|---|---|
| 1,2,3-Trichloropropane | Vinyl acetate | Vinyl chloride |
| o-Xytene | m-Xylene | p-Xylene |

IS = internal standard; surr = surrogate

Example 1

Performance Test Method

The efficiency of the presently disclosed solvent compositions to remove petroleum residue (e.g., bitumen) from a substrate was quantified by the following test methods:

Step 1. Number each aluminum dish and determine its weight. The dishes used are FISHERBRAND™ Aluminum Weighing Dishes (Fisher Scientific, Pittsburgh, Pa.). The catalog number is 08-732 and the capacity of each dish is 42 mL.

Step 2. Apply 1.5 g of emulsified asphalt (CRS-2) into the standard aluminum dish, ensuring that asphalt emulsion fully covers the bottom surface area of the dish.

Step 3. Heat the aluminum dish, with asphalt emulsion, for 24 hours at the temperature of 140° F. (60° C.).

Step 4. Remove the dish after 24 hours and cool it to room temperature. Determine the weight of the dish and calculate the weight of residual asphalt.

Step 5. Apply 0.5 g of solvent into the dish by dropper. Make sure that the asphalt remains completely submerged in the solvent for 5 minutes.

Step 6. Let the dish drain for 5 minutes by putting it upside down.

Step 7. Rinse the dish thoroughly for 5 minutes under running water.

Step 8. Heat the dish at 140° F. (60° C.) for 15 hours to remove the traces of water completely.

Step 9. Weigh the dish to calculate asphalt removed. Results are presented in Example 2.

Example 2

Bitumen Removal Obtained from Different Solvent Compositions

The data presented in this Example were developed using the approaches and methods described in Example 1. Representative solvent compositions and their efficiency for removing bitumen according to the method described in Example 1 are presented in Table 2.

TABLE 2

Table 2. Bitumen Removal Obtained from Different Solvent Compositions.

| Solvent Composition* | Average Efficiency Value (% Bitumen Removed)** | Average Efficiency Value (% Bitumen Removed) Plus 2.811 From Diesel Measurements*** |
|---|---|---|
| Diesel Fuel | 13.19 | 16.00 |
| 50% IPB + 40% Bio + 10% Butyl Carbites | 18.50 | 21.31 |
| 40% IPS + 50% Bio + 10% Butyl Carbitol (10% Water) | 16.80 | 19.70 |
| 40% IPB (10% Witconol ™ CO 360) + 50% BiO + 10% Butyl Carbitol (10% Water) | 17.82 | 20.63 |

TABLE 2-continued

Table 2. Bitumen Removal Obtained from Different Solvent Compositions.

| Solvent Composition* | Average Efficiency Value (% Bitumen Removed)** | Average Efficiency Value (% Bitumen Removed) Plus 2.811 From Diesel Measurements*** |
|---|---|---|
| 40% IPB (20% Witconol ™ CO 360) + 50% Bio + 10% Butyl Carbitol (10% Water) | 17.88 | 20.69 |
| 40% IPB + 50% Bio + 10% Butyl Carbitol (20% Water) | 17.29 | 20.10 |
| 40% IPB + 50% Witconol ™ CO 360) + 50% BiO + 10% Butyl Carbitol (20% Water) | 17.29 | 20.10 |
| 40% IPS + 0.8% Witconol ™ CO 360 + 50% Bio + 10% Butyl Carbitol + 2% Water | 17.17 | 19.98 |
| 10% IPB + 70% Bio + 20% d-Limonene | 17.01 | 19.82 |
| 20% IPB + 60% Bio + 20% d-Limonene | 17.49 | 20.30 |

*IPB = isopropyf benzoic acid ester and Bio = biodiesel; Witconol ™ CO 360 is a product of Akzo Nobel Surface Chemistry ILLC, Chicago, Illinois, USA,
**Diesel Fuel Efficiency Value as Measured in our Experiments.
***Diesel Fuel Efficiency Value as Reported by Kulkami, M., et al., J of Testing and Evaluation, 31(5), 429-437 (2003).

It will be understood that various details of the presently disclosed subject matter can be changed without departing from the scope of the presently disclosed subject matter. Furthermore, the foregoing description is for the purpose of illustration only, and not for the purpose of limitation.

What is claimed is:

1. An environmentally friendly method of cleaning a substrate comprising:

applying a biodegradable solvent composition, from about 1 to about 20 minutes at a temperature ranging from about 10° C. to about 50° C., on a petroleum residue containing substrate thereby forming an aqueous sludge, wherein the solvent composition has a pH of about 7;

filtering the aqueous sludge and thus separating insoluble contaminates; and preparing the solvent composition for recycling or disposal comprising at least one of:

separating the solvent composition from the residue, or solubilizing, suspending, or entraining the residue in the solvent composition after the residue is removed from the substrate, wherein the solvent composition comprises:

from about 30% to about 60% by weight % of a biodiesel;

from 40% to 60% by weight of an aromatic ester selected from the group consisting of methyl benzoic acid ester, ethyl benzoic acid ester, n-propyl benzoic acid ester, isobutyl benzoic acid ester, n-butyl benzoic acid ester, tert-butyl benzoic acid ester, isomers of pentyl benzoic acid ester, isopropyl benzoic acid ester, and combinations thereof;

about 0-10% by weight of diethylene glycol ether;

about 0-20% by weight of a cyclic terpene or terpenoid; and a corrosion inhibitor.

2. The method of claim 1, wherein the aromatic ester is isopropyl benzoic acid ester present in an amount of about 50% by weight.

3. The method of claim 1, further comprising a nonionic surfactant in an amount of about 0-20% by weight.

4. The method of claim 1, wherein the biodiesel is present in an amount of about 40% by weight.

5. The method of claim 1, wherein the and wherein the diethylene glycol ether is diethylene glycol monobutyl ether present in an amount of about 10% by weight.

6. The method of claim 1, wherein separating the solvent composition from the residue comprises subjecting the filtered aqueous sludge to a compressed gas comprising a mixture of ammonia and carbon dioxide at a ratio ranging from about 1:10 to about 10:1 by volume ammonia:carbon dioxide.

7. The method of claim 1, wherein the substrate is one of: equipment, tools, wildlife, tar sand, heavy machinery parts, motorcycle parts, automotive parts, aggregates, sand dunes, sewage lagoons, oxidation ponds, waste ponds, water barriers, swimming pools, and trees.

8. The method of claim 1, wherein the residue is a result of a crude oil spill.

* * * * *